US011475858B2

(12) United States Patent
Zhao et al.

(10) Patent No.: US 11,475,858 B2
(45) Date of Patent: Oct. 18, 2022

(54) DRIVING METHOD AND CIRCUIT OF DISPLAY PANEL AND DISPLAY DEVICE

(71) Applicant: HKC CORPORATION LIMITED

(72) Inventors: Wenqin Zhao, Guangdong (CN); Haijiang Yuan, Guangdong (CN); Yubo Gu, Guangdong (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/159,432

(22) Filed: Jan. 27, 2021

(65) Prior Publication Data

US 2022/0036840 A1 Feb. 3, 2022

(30) Foreign Application Priority Data

Jul. 28, 2020 (CN) ..... 202010742849.1

(51) Int. Cl.
*G09G 3/36* (2006.01)

(52) U.S. Cl.
CPC ..... *G09G 3/3614* (2013.01); *G09G 3/3677* (2013.01); *G09G 3/3688* (2013.01); *G09G 2310/0202* (2013.01); *G09G 2320/0233* (2013.01)

(58) Field of Classification Search
CPC combination set(s) only.
See application file for complete search history.

(56) References Cited

U.S. PATENT DOCUMENTS 3,921,162 A 11/1975 Fukai et al.
9,311,873 B2 * 4/2016 He ..... G09G 3/3614
2005/0190176 A1 * 9/2005 Tomitani ..... G02F 1/136213 345/204
2007/0115244 A1 * 5/2007 Shin ..... G09G 3/3266 345/100

(Continued)

FOREIGN PATENT DOCUMENTS

CN 101312026 A 11/2003
CN 101739935 A 6/2010

(Continued)

OTHER PUBLICATIONS

Chinese Office Action dated Feb. 20, 2021, for HKC Corporation Limited, Chinese Application No. 202010742849.1, filed Jul. 28, 2020.

*Primary Examiner* — Van N Chow
(74) *Attorney, Agent, or Firm* — Law Offices of Albert Wai-Kit Chan, PLLC

(57) ABSTRACT

The disclosure discloses a driving method and a circuit of a display panel and a display device. The driving method includes the following steps: acquiring image data of a screen to be displayed; acquiring a voltage polarity corresponding to each row of image data in the image data, in responding to a determination that the image data of the screen to be displayed are image data of a heavy-load screen; sorting rows of image data according to voltage polarities and generating sorting labels; compensating image data voltage of a corresponding row according to the sorting labels; scanning gate lines of the display panel in sequence according to the sorting labels; and outputting compensated image data of the corresponding row to a corresponding data line of the display panel to display the screen to be displayed.

13 Claims, 4 Drawing Sheets

(56) References Cited

U.S. PATENT DOCUMENTS

| | | | | |
|---|---|---|---|---|
| 2007/0285377 | A1* | 12/2007 | Yamazaki | G09G 3/3648 345/101 |
| 2008/0291189 | A1* | 11/2008 | Song | G09G 3/3614 345/209 |
| 2010/0128011 | A1* | 5/2010 | Ito | G09G 3/3688 345/55 |

FOREIGN PATENT DOCUMENTS

| | | | |
|---|---|---|---|
| CN | 108365788 | A | 8/2018 |
| CN | 109994081 | A | 7/2019 |
| JP | 0764055 | A | 3/1995 |
| KR | 20070120351 | A | 12/2007 |

* cited by examiner

DRIVING METHOD AND CIRCUIT OF DISPLAY PANEL AND DISPLAY DEVICE

CROSS REFERENCE TO RELATED APPLICATIONS

The present disclosure claims the priority to Chinese Patent Application No. 202010742849.1 which is entitled "DRIVING METHOD AND CIRCUIT OF DISPLAY PANEL AND DISPLAY DEVICE" and filed on Jul. 28, 2020, the entire contents of which are incorporated herein for reference.

TECHNICAL FIELD

The disclosure relates to the technical field of liquid crystal displays, in particular to a driving method and a driving circuit of a display panel and a display device.

BACKGROUND

In the mode of sequential scanning of the display panel, when special heavy-load conditions occur, the power of the source driver will greatly increase and the calorific value will increase, thus bringing risks to the normal operation of the liquid crystal display. In order to optimize the working state of liquid crystal display under this special heavy-load condition, a new non-sequential scanning technology of gate driver is proposed. For example, under the normal screen, the scanning mode of the gate driver is progressive scanning mode, and when heavy-load is detected, the scanning mode of the gate driver will switch to non-sequential scanning mode. Depending on the difference of the display screen, it is possible to switch between the sequential scanning mode and the non-sequential scanning mode in units of frames.

However, when performing non-sequential scanning, stripe feeling of the display screen may be generated because the charging efficiency is different between different rows.

SUMMARY

The main purpose of the disclosure is to provide a driving method and a driving circuit of a display panel and a display device, aiming at solving the problem of bright rows and dark rows on the display panel and improving the screen quality of the display device.

In order to achieve the above object, the disclosure provides a driving method of a display panel, which includes the following steps:

acquiring image data of a screen to be displayed;

acquiring a voltage polarity corresponding to each row of image data in the image data, in responding to a determination that the image data of the screen to be displayed are image data of a heavy-load screen;

sorting rows of image data according to voltage polarities and generating sorting labels;

compensating image data voltage of a corresponding row according to the sorting labels;

scanning gate lines of the display panel in sequence according to the sorting labels; and, outputting compensated image data of the corresponding row to a corresponding data line of the display panel to display the screen to be displayed.

In an embodiment, the step of sorting rows of image data according to voltage polarities and generating sorting labels includes:

setting the image data of the screen to be displayed as N units of image data, each of the units of image data comprising M groups of image data with positive voltage polarity and M groups of image data with negative voltage polarity, each group of image data with the positive voltage polarity and each group of image data with the negative voltage polarity comprising at least two rows of image data;

alternately sorting the M groups of rows of image data with positive voltage polarity and the M groups of rows of image data with negative voltage polarity.

In an embodiment, the step of compensating image data voltage of the corresponding row according to the sorting labels includes:

compensating an image data voltage of a first row in each group of image data with positive voltage polarity, a compensation image data voltage of the first row being equal to a voltage difference between the first row of image data with positive voltage polarity and a last row of image data in each group of image data with positive voltage polarity.

In an embodiment, the specific step of compensating image data voltage of the corresponding row according to the sorting labels includes:

compensating an image data voltage of a first row in each group of image data with negative voltage polarity, and a compensation image data voltage of the first row being equal to a voltage difference between the first row of image data with negative voltage polarity and a last row of image data in each group of image data with negative voltage polarity In an embodiment, the step of sorting rows of image data according to voltage polarities and generating sorting labels further includes:

sorting rows of image data with positive voltage polarity of each group according to an order of original image row numbers and generating the sorting labels, the original image row numbers being row numbers of the rows of image data in the image data.

In an embodiment, the step of sorting rows of image data according to voltage polarities and generating sorting labels further includes:

sorting rows of image data with negative voltage polarity of each group according to an order of the original image row numbers and generating the sorting labels, the original image row numbers being the row numbers of the rows of image data in the image data.

In an embodiment, after the step of acquiring image data of a screen to be displayed, the driving method further includes:

scanning the gate lines of the display panel row by row to display the screen to be displayed in responding to a determination that the image data of the screen to be displayed are image data of a normal screen.

The present disclosure further provides a driving circuit of a display panel including:

a sequential controller for acquiring image data of a screen to be displayed, acquiring a voltage polarity corresponding to each row of image data in the image data, in responding to a determination that the image data of the screen to be displayed are the image data of a heavy-load screen, sorting rows of image data according to voltage polarities and generating sorting labels, and compensating image data voltage of a corresponding row according to the sorting labels;

a gate driver for sequentially scanning gate lines of the display panel according to the sorting labels;

a source driver for outputting compensated image data of the corresponding row to a corresponding data line of the display panel to display the screen to be displayed.

In an embodiment, the sequential controller is further for setting the image data of the screen to be displayed as N units of image data, each of the units of image data comprising M groups of image data with positive voltage polarity and M groups of image data with negative voltage polarity, each group of image data with the positive voltage polarity and each group of image data with the negative voltage polarity comprising at least two rows of image data, and alternately sorting the M groups of rows of image data with positive voltage polarity and the M groups of rows of image data with negative voltage polarity;

sorting rows of image data with positive voltage polarity of each group according to an order of original image row numbers and generating sorting labels, the original image row numbers being row numbers of the rows of image data in the image data, sorting rows of image data with negative voltage polarity of each group according to the order of the original image row numbers and generating sorting labels, the original image row numbers being the row numbers of the rows of image data in the image data;

compensating an image data voltage of a first row in each group of image data with positive voltage polarity, a compensation image data voltage of the first row being equal to a voltage difference between the first row of image data with positive voltage polarity and a last row of image data in each group of image data with positive voltage polarity; and compensating an image data voltage of a first row in each group of image data with negative voltage polarity, and a compensation image data voltage of the first row being equal to a voltage difference between the first row of image data with negative voltage polarity and a last row of image data in each group of image data with negative voltage polarity.

The present disclosure further provides a display device including a display panel and a driving circuit for the display panel described above, the driving circuit of the display panel is connected with the display panel.

According to the present disclosure, by acquiring image data of a screen to be displayed, and when the image data of the screen to be displayed is image data of a heavy-load screen, a voltage polarity corresponding to each row of image data is acquired. Then rows of image data are sorted according to voltage polarities and sorting labels are generated. At the same time, the image data voltage of the corresponding row is compensated according to the sorting labels. Then the gate lines of the display panel are scanned in sequence according to the sorting labels, so that the compensated image data of a row is output to the data lines of the display panel to display the screen to be displayed. According to the disclosure, pixel compensations are carried out on the pixel rows with requirement to switch the voltage polarity, so that the charging efficiency of the pixel rows with requirement to switch the voltage polarity is consistent with the charging efficiency of the pixel rows without requirement to switch the voltage polarity, and the charging effects of the pixel rows are the same and the brightnesses are consistent. The disclosure solves the problem of bright and dark rows, i.e. stripe feeling, due to differences in charging saturation degree between pixel rows due to large voltage span when the polarities of image data voltage in pixel rows are reversed under heavy-load screens, and improves the screen quality of the display device.

BRIEF DESCRIPTION OF THE DRAWINGS

In order to have the embodiment of the present disclosure or the technical scheme in the prior art more clearly explained, a brief description of the accompany drawings desired to be used in the description of embodiments or prior art is provided. It will be apparent that the drawings in the following description are only some embodiments of the disclosure, and other drawings may be obtained from the structure shown in these drawings without creative effort by those of ordinary skill in the art.

Figure 1:
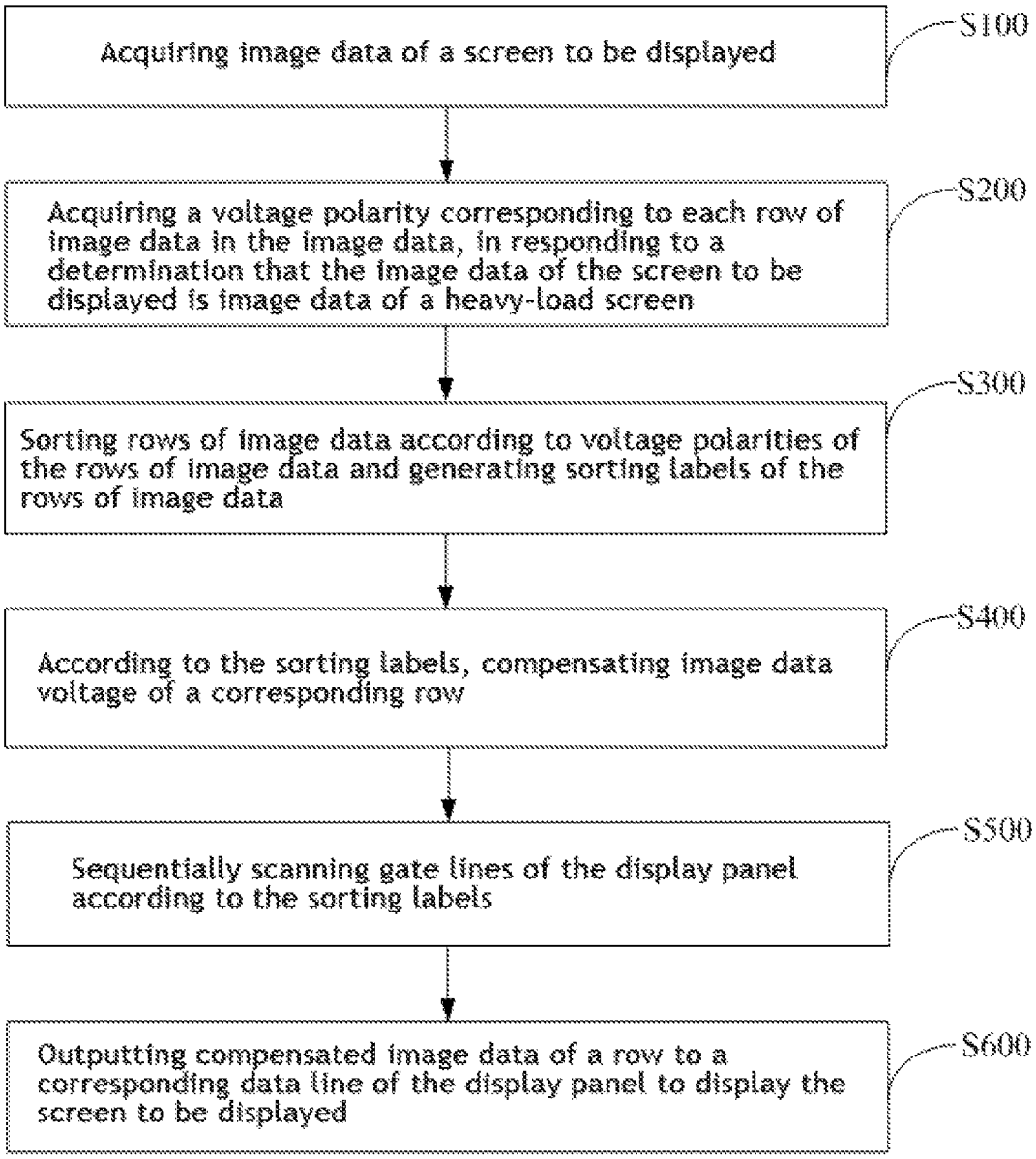
FIG. 1 is a flow diagram of an embodiment of a driving method of a display panel of the present disclosure.

The realization of purposes, functional features and advantages of the present disclosure will be further explained in connection with embodiments and with reference to the accompanying drawings.

DETAILED DESCRIPTION OF THE EMBODIMENTS

A clear and complete description of the technical aspect of the embodiments of the present disclosure will be given below in connection with the accompany drawings in which the embodiments of the present disclosure are taken, and it will be apparent that the described embodiments are only part of the embodiments of the present disclosure, and not all of them. Based on the embodiments of the present disclosure, all other embodiments obtained by those of ordinary skill in the art without creative work fall within the scope of protection of the present disclosure.

It should be noted that if there are directional indications (such as upper, lower, left, right, front, rear, etc.) in embodiments of the present disclosure, the directional indications are only used to explain the relative positional relationship, motion situation, etc. between components under a specific posture (as shown in the drawings), and if the specific posture changes, the directional indications also change accordingly.

In addition, if there are descriptions referring to "first", "second" and the like in embodiments of the present disclosure, the descriptions of "first", "second" and the like are for descriptive purposes only and cannot be construed as indicating or implying their relative importance or implying the number of indicated technical features. Thus, features defined as "first" and "second" may explicitly or implicitly include at least one of the features. In addition, the technical solutions between various embodiments can be combined with each other, but must be based on the ability of one of ordinary skill in the art to realize, and when the combination of technical solutions is inconsistent or cannot be realized, it should be considered that the combination of such technical solutions does not exist and is not within the scope of protection claimed by the present disclosure.

As use herein, that term "and/or" is merely an association relationship that describes the associate object, indicating that there may be three relationships, e.g., A and/or B, and that there may be three situations: A alone, A and B simultaneously, and B alone. In addition, the character "/" in this article generally indicates that the anterior and posterior related objects are an "or" relationship.

The disclosure provides a driving method of a display panel.

In recent years, liquid crystal display (LCD) is very popular because of its small volume, light weight, low power consumption and high display quality, and gradually replaces the previous cathode ray screen tube (CRT) display. The application field of liquid crystal display is gradually expanding, from audio and video products, notebook computers and other displays to desktop computers, engineering workstation (EWS) monitors and so on.

The driving of liquid crystal display is to establish a driving electric field by adjusting the phase, peak value, frequency, etc. of the potential signal applied to the electrodes of the liquid crystal device to realize the display effect of the liquid crystal display device. There are many driving methods for liquid crystal display, and the commonly used driving method is the dynamic driving method. When there are many pixels displayed on the liquid crystal display device (for example, dot matrix liquid crystal display device), in order to save a huge hardware drive circuit, processing is carried out on the fabrication and arrangement of the electrodes of the liquid crystal display device, and a matrix structure is implemented, namely back electrodes of a horizontal group of display pixels are all connected together and led out, which is called row electrodes; segment electrodes of a longitudinal group of display pixels are all connected and led out together, which is called column electrodes. Each display pixel on the liquid crystal display device is uniquely determined by the position of its column and row, and a raster scanning method similar to CRT is correspondingly adopted in the driving mode.

Figure 4:
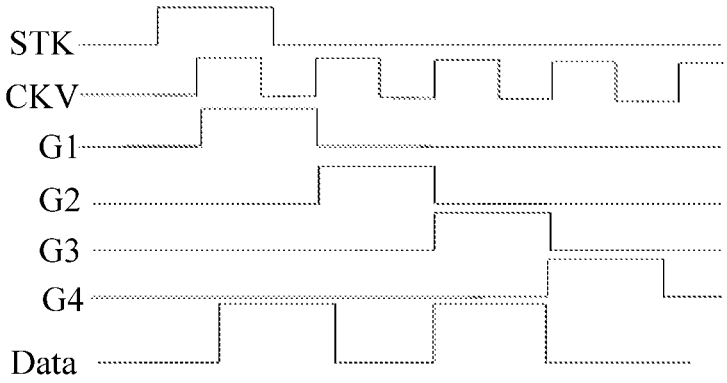
FIG. 4 is a timing diagram of an embodiment when a display screen of a display panel of the present disclosure is a normal screen.

Referring to FIG. 4, the dynamic driving method of a liquid crystal display is to cyclically apply selection pulses (i.e., scanning the row) to the row electrodes while all column electrodes displaying data give corresponding selection or non-selection driving pulses, thus realizing the display function of all display pixels in a certain row. This kind of row scanning is carried out in a row-by-row sequence (i.e. Sequential scanning, e.g. from top to bottom, or from bottom to top), with a short cycle, so that a stable display is displayed on the liquid crystal display screen.

Referring to FIG. 1, four rows (e.g., G1, G2, G3, and G4) are scanned as an example. As use herein, that term "row" refers to a row of pixels, and scanning a row of pixels may also be referred to as opening the row of pixels. For example, according to the gate signal CKV output by the sequential controller, G1 is first scanned, then G2 is scanned, then G3 is scanned, and finally G4 is scanned. The gate signal CKV is a periodic signal, each cycle corresponding to scanning a row. However, when some special cases (e.g., heavy-load screens) occur, in the sequential scanning mode, since the data output by the source driver is alternately positive and negative, for example, when the voltage polarity corresponding to G1 row data is positive, the voltage polarity corresponding to G2 row data is negative. As such, perform a row scan will result in that data voltage of the source driver need to be continuously switched between positive polarity and negative polarity, Four rows of pixels need to switch voltage polarity three times, and the data lines of the display panel generate large power consumption during charging and discharging, the power consumption expression is: $P=\frac{1}{2}CFV2$ (C is the capacitor capacity, F is the voltage switching frequency, and V is the voltage). From this expression, it can be seen that power consumption is related to the voltage switching frequency, and the greater the voltage switching frequency, the greater the power consumption. When a normal screen is displayed, the generated power consumption is not very high. However, when displaying a heavy-load screen, due to the larger value of the voltage switching frequency F of the heavy-load screen, the display device will generate larger power consumption, and in serious cases, the drive chip may be damaged due to too high temperature, thus bringing risks to the normal operation of the liquid crystal display and not conducive to its normal operation.

Figure 5:
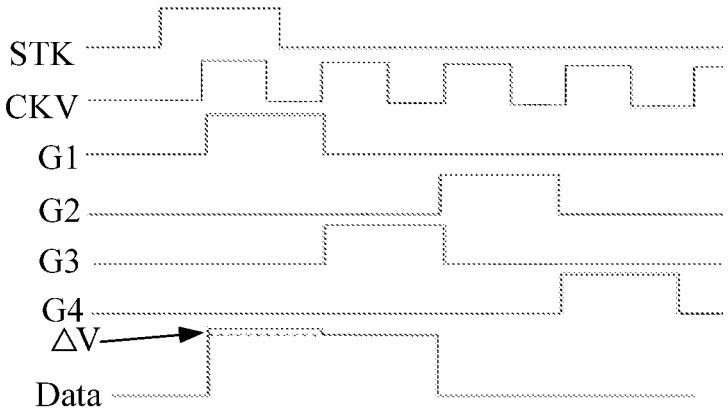
FIG. 5 is a timing diagram of an embodiment when the display screen of the display panel of the present disclosure is a heavy-load screen.

Referring to FIG. 5, in order to optimize the operating state of the liquid crystal display under this special heavy-load condition, a new technique of non-sequential scanning of the gate driver has been proposed. For example, under the normal screen, the scanning mode of the gate driver is the sequential scanning mode, and when heavy-load is detected, the scanning mode of the gate driver will be switched to the non-sequential scanning mode. Still taking the example of scanning four rows (e.g., G1, G2, G3, and G4). In order to optimize the operating state of the liquid crystal display under the heavy-load screen, when heavy-load is detected, the gate driver switches from a sequential scanning mode to a non-sequential scanning mode. In the non-sequential scanning mode, the scanning of the rows is not from top to bottom, but the pixel rows of two or more rows with same voltage polarity can be scanned sequentially, then switched to the pixel rows with opposite polarity, and the pixel rows with opposite pixels can be scanned sequentially. For example, the voltage polarities of G1 and G3 are both positive, and the voltage polarities of G2 and G4 are opposite to the voltage polarities of G1 and G3 and both are negative. According to the gate signal CKV output by the gate driver, G1 can be scanned first, then G3, then G2 and finally G4. Thus, when scanning from line G1 to line G3, The polarity of G1 is positive, the polarity of G3 is positive. When scanning to G2, it is switched to negative. When scanning from G2 to G4, the polarity of G4 is negative. For four rows of pixel rows, the problem of power increasing can be solved by switching the voltage polarity once, thus reducing calorific value and ensuring the normal operation of the display panel.

It can be understood that under the condition that the potential of the common electrode remains unchanged, the realization of AC driving of liquid crystal molecules is equivalent to the change of the potential of the other electrode of the capacitor going high and low relative to the potential of the common electrode. That is, the data voltage output by the source driver increases or decreases relative to the common electrode voltage. However, in the process of switching from a negative polarity voltage to a positive polarity voltage by increasing the data voltage relative to the common electrode voltage, or decreasing to realize switching from the positive polarity voltage to the negative polarity voltage, the voltage span of the data voltage is relatively large, and due to RC load, voltage switching requires climbing time. Therefore, under the condition of a certain charging time, The charging rate of the pixel row which needs to undergo voltage switching, i.e. climbing time, is lower than that of the pixel row whose voltage tends to be stable (e.g., the charging rate of G1 is lower than that of G3, the charging rate of G2 is lower than that of G4), That is, the charging saturation degree of the former pixels is less than that of the latter, while the brightness of the charged saturated sub-pixels is greater than that of the sub-pixels that are not completely saturated. In non-sequential scan mode, the G1 row scanning line is open first, the G3 row scanning line is open after, the polarity of the G1 pixel row is reversed from a positive electrode to a negative electrode. During the charging process of the G1 pixel row, the data voltage on the data line D2 will gradually increase from the low level to the high level, i.e. the negative electrode will be switched to the positive electrode and the low level will be maintained. At this time, the voltage span of the data is large, and when the charging of the G1 pixel row is completed, the charging of the G1 pixel row is not saturated. After the charging of the G1 pixel row is finished, The G1 row scanning line is turned off and the G3 row scanning line is turned on, thus the G3 pixel row is charged. During the charging process of the G3 pixel row, the data voltage on the data line D2 is kept at a low level, which is equivalent to switching from the positive electrode to the positive electrode. At this time, the data voltage span is small or there is no voltage span, so the saturation degree is high when the charging of G3 pixel row is completed. In this way, the brightness of the G3 pixel rows will be higher than that of the G1 color pixel rows. Similarly, the brightness of the G4 pixel rows will be higher than that of the G2 color pixel rows, and so on, the problem of bright/dark rows will appear on the entire liquid crystal panel.

In order to solve the above problems, referring to FIG. 1, in an embodiment of the present disclosure, the driving method of the display panel includes the following steps:

Step S100, acquiring image data of a screen to be displayed.

In this embodiment, the acquiring of the image data of the screen to be displayed is specifically that: the sequential controller receives the image data of the screen to be displayed transmitted by a front end, and the sequential controller converts the image data and control signals received from the front end into data signals, control signals and clock signals suitable for a source driver and a gate driver. The source driver converts the received digital signals into corresponding gray-scale voltage signals. As the gate driver scans row by row, all column data signal lines transmit data signals to a pixel row, and a capacitor of each sub-pixel in the pixel row is charged to realize the writing and holding of the signal voltages of the sub-pixel. The liquid crystal molecules of the sub-pixel rotate under the voltage, so that the transmittance of the incident light passing through the liquid crystal molecules changes, i.e. the light valve effect of the incident light is realized, the brightness of the projected light is changed, and finally the image display of the display panel is realized. Since the display screen of the display panel is displayed frame by frame, the sequential controller receiving the image data of the front end is also frame by frame. Since polarity reversal occurs between frames, the sequential controller also obtains a voltage polarity of each image data in units of one frame. One or two frames of the image data are stored in a memory of the sequential controller to facilitate the sequential controller to analyze and process the one or two frames of the image data so as to continue to perform the following steps.

Step S200, acquiring a voltage polarity corresponding to each row of image data in the image data, in responding to a determination that the image data of the screen to be displayed is image data of a heavy-load screen.

In this embodiment, the power consumption generated by the display device is mainly caused by the image nature of the screen to be displayed, for example, when displaying a heavy-load screen, the display device will generate large power consumption. Therefore, the display method can be used to display some special screens similar to heavy-load screens, and the display method can also be used for normal screens. By combining the display method with the existing display method, better results can be obtained. Therefore, when using the display method, it is necessary to first judge whether the image data of the screen to be displayed is image data of a heavy-load screen and generate a judgment result. Specifically, a brightness value difference amount of the sub-pixels in the screen to be displayed in a sampling area can be calculated. If the brightness value difference amount contained in the screen is greater than a preset threshold value, the screen to be displayed is determined to be a heavy-load screen, otherwise it is a light-load screen. If the judgment result is a heavy-load screen, the voltage polarity corresponding to each row of image data is obtained.

S300, sorting rows of image data according to voltage polarities of the rows of image data and generating sorting labels of the rows of image data.

Referring to FIG. 4, in this embodiment, two or more rows of pixels with same polarity can be grouped into a pixel group, and pixel groups can be sorted. For example, G1 and G3 are listed as a small unit, G2 and G4 are listed as a small unit, then the scanning order of G1 to G4 after reordering is G1, G3, G2, G4, Or G3, G1, G4, G2, or G2, G4, G1, G3, etc., after sorting according to the voltage polarity, corresponding sorting labels are generated. At this time, G1 to G4 will regenerate sorting labels of numbers 1, 2, 3, and 4, for example, G1 corresponds to 1, G3 corresponds to 2, G2 corresponds to 3, G4 corresponds to 4, and so on, four rows of pixels can be sorted as one unit, and pixel rows of G5 to Gn can be sorted. Of course, in other embodiments, six rows can be sorted as one unit, or eight rows can be sorted as one unit. No limitation is made here.

Step S400, according to the sorting labels, compensating image data voltage of a corresponding row.

after determining a heavy-load screen and reordering the G1-Gn pixel rows, the number and positions of pixel rows to be compensated can be determined. For example, in G1-G4, it can be determined that G1 and G2 need compensation, and in G5-G8, G5 and G8 need compensation. In practical applications, the image data voltage and the brightness of the display panel on each gray scale can be reflected through the voltage-brightness V-T curve, and the two have a mapping relationship. That is, each brightness of the display panel corresponds to an image data voltage. Therefore, in the present embodiment, through acquiring the brightness of the display panel, and after acquiring the brightness of the display panel, the image data voltage corresponding to the brightness of the display panel under a current gray scale can be obtained by reading the voltage-brightness V-T curve of the display panel. Specifically, after acquiring the brightness of each pixel, a brightness difference T between the pixel rows in the small unit, such as a brightness difference between G1 and G3, and a brightness difference between G2 and G4, are calculated. Then the image data voltage values of G1 and G3 are read through the voltage-brightness V-T curve, and a difference of the image data voltage values of G1 and G3 are calculated, thereby a voltage difference, which is the compensation voltage V, is obtained. After acquiring the compensation voltage V of each pixel row, the compensation voltage V of each pixel row can be stored in the sequential controller, and a look-up table of inputs and outputs of each pixel row can be established in the sequential controller. When it is determined that the screen to be displayed is a heavy-load screen, the original data information is processed and output, specifically, the corresponding compensation voltage V is added to each pixel row to be compensated, so as to ensure that the charging saturation between each pixel row in each display panel is the same or basically the same.

S500, sequentially scanning gate lines of the display panel according to the sorting labels.

After receiving a timing signal, a frame start signal and other signals output by the sequential controller, the gate driver performs non-sequential scanning on each pixel row in the display panel according to the rearranged scanning sequence label. For example, the scanning order after reordering is G1, G3, G2, G4, G5, G7, G6, G8, . . . , Gn, and the pixel row scanning of the entire display panel is completed.

Step S600, outputting compensated image data of a row to a corresponding data line of the display panel to display the screen to be displayed.

The source driver receives image data signal that does not need to be compensated by the sequential controller and the compensated image data signal. When a pixel row needed to be compensated is opened, the source driver transmits the corresponding compensated data signal to the pixel row through all column data signal lines to charge the capacitor of each sub-pixel in the pixel row. When pixel rows without requiring compensation are opened, a source driver transmits raw data signal to the pixel rows through all column data signal lines. The capacitor of each sub-pixel in the pixel row is charged to realize the writing and holding of the signal voltage of the sub-pixel. The liquid crystal molecules of the sub-pixel rotate under the voltage, so that the transmittance of the incident light passing through the liquid crystal molecules changes, i.e. the light valve function on the incident light is realized, the brightness of the projected light is changed, and finally image display of the display panel is realized. With this arrangement, the charging efficiency of the pixel rows with requirement to switch the voltage polarity can be kept consistent with the charging efficiency of the pixel rows without requirement to switch the voltage polarity. It is beneficial to ensure that the charging effects of all pixel rows are the same and the brightnesses are the same when the voltage of the data signal is switched from positive polarity to negative polarity or from negative polarity to positive polarity.

According to the present disclosure, by acquiring image data of a screen to be displayed, and when the image data of the screen to be displayed is image data of a heavy-load screen, a voltage polarity corresponding to each row of image data is acquired. Then rows of image data are sorted according to voltage polarities and sorting labels are generated. At the same time, the image data voltage of the corresponding row is compensated according to the sorting labels. Then the gate lines of the display panel are scanned in sequence according to the sorting labels, so that the compensated image data of a row is output to the data lines of the display panel to display the screen to be displayed. According to the disclosure, pixel compensations are carried out on the pixel rows with requirement to switch the voltage polarity, so that the charging efficiency of the pixel rows with requirement to switch the voltage polarity is consistent with the charging efficiency of the pixel rows without requirement to switch the voltage polarity, and the charging effects of the pixel rows are the same and the brightnesses are consistent. The disclosure solves the problem of bright and dark rows, i.e. stripe feeling, due to differences in charging saturation degree between pixel rows due to large voltage span when the polarities of image data voltage in pixel rows are reversed under heavy-load screens, and improves the screen quality of the display device.

In one embodiment, the step of sorting rows of image data according to voltage polarities of the rows of image data and generating sorting labels of the rows of image data specifically includes:

setting the image data of the screen to be displayed as N units of image data, each of the units of image data includes M groups of image data with positive voltage polarity and M groups of image data with negative voltage polarity, each group of image data with the positive voltage polarity and each group of image data with the negative voltage polarity includes at least two rows of image data;

alternately sorting the M groups of rows of image data with positive voltage polarity and the M groups of rows of image data with negative voltage polarity.

In this embodiment, the numbers X of pixel rows of display panels are different according to different sizes and resolutions of the display panels. For example, in some embodiments, the value of X may be set to 1080, and the value of N may be equivalent to 2, 4, 8. When the value of N is 2, that is, the whole display panel is divided into two units of image data, each unit of image data includes image data corresponding to X/2 pixel rows, and the value of M may be X/4. Alternatively, the value of N may be X/4. Each unit of image data includes image data corresponding to four pixel rows. And the image data of two pixel rows with same voltage polarity act as a group, and the value of M is 1 at this time. For example, the image data corresponding to G1-G4 is a unit, and the image data corresponding to G5-G8 is a unit. Each unit includes a group of image data with positive voltage polarity and a group of image data with negative voltage polarity. Of course, in other embodiments, the value of N may also be X/6. Each unit of image data includes image data corresponding to six pixel rows, and the image data of three pixel rows with same voltage polarity acts as a group. At this time, the value of M is 1. For example, the image data corresponding to G1 to G6 are a unit, G1, G3 and G5 represent a group with positive voltage polarity, and G2, G4 and G6 represent a group with negative voltage polarity.

When sorting, it can sort in groups, for example in a unit of image data, eight pixel rows are included. The eight pixel rows include two groups of corresponding pixel rows with positive voltage polarity of image data and two groups of pixel rows with negative voltage polarity of image data. This embodiment is explained by taking G1 to G8 as examples. In G1 to G8, the corresponding voltage polarity of image data of G1, G3, G5 and G7 is positive, and the corresponding voltage polarity of image data of G2, G4, G6 and G8 is negative. The reordered scanning sequence of G1 to G8 is G1, G3, G2, G4, G5, G7, G6 and G8.

In other embodiments, the order of M groups of rows of image data with positive voltage polarity takes precedence over the order of M groups of rows of image data with negative polarity. Alternatively, the order of the M groups of rows of image data with negative polarity is superior to the order of the M groups of rows of image data with positive voltage polarity. Specifically, since the rows of image data is reordered according to the voltage polarities, the voltage of the image data does not frequently switch between the positive and negative polarities, Instead, all the pixel rows corresponding to the positive polarity of image data are scanned first. In a specific embodiment, the display panel has 1080 gate lines (scanning lines). When the display method of the present disclosure displays a heavy-load screen, 540 high-level voltages continuously outputs first, then 540 low-level voltages continuously outputs, or 540 low-level voltages continuously outputs first, and then 540 high-level voltages continuously outputs, so that only two positive-negative switches or negative-positive switches are required. In this way, voltage polarity switching between pixel rows can be reduced, and the problem of power increasing can be solved, thereby reducing calorific value and ensuring the normal operation of the display panel. In addition, when compensating, only the voltage of image data corresponding to the first pixel row and the voltage of image data corresponding to the 541st pixel row need to be compensated, and the number of compensation voltages of the sequential controller can be reduced at the same time.

In one embodiment, the step of compensating image data voltage of a corresponding row according to the sorting labels specifically includes:

compensating an image data voltage of a first row in each group of image data with positive voltage polarity, a compensation image data voltage of the first row being equal to a voltage difference between the first row of image data with positive voltage polarity and the last row of image data in each group of image data with positive voltage polarity.

In this embodiment, After determining the number of rows of pixels with positive voltage polarity for each group, such as two or three rows, the brightness of the display panel can be obtained. After acquiring the brightness of the display panel, by reading the voltage-brightness V-T curve of the display panel, the image data voltages of pixel rows in each group are read through the voltage-brightness V-T curve. Understandably, the climbing time for voltage switching is generally short, compared to the effect to the first row in a group of pixel rows, in the pixel group of image data with same image voltage polarity, the image data voltage corresponding to the second row or each pixel rows after the second row has stabilized. For example, G1, G3 and G5 are in a group, G1 needs to go through a period of climbing before stabilizing, while G3 and G5 directly transit to stabilized condition without climbing phenomenon. Therefore, it is possible to calculate the difference between the image data voltages corresponding to the first pixel row and the last pixel row, so as to obtain the difference between the image data voltages corresponding to the first pixel row and the last pixel row, which is the compensation voltage V for the first pixel row. After acquiring the compensation voltage V of the first pixel row each group, the compensation voltage V of each pixel row can be stored in the sequential controller, and a look-up table of input and output of each first pixel row can be established in the sequential controller. When it is determined that the screen to be displayed is a heavy-load screen, the original data information is processed and output, specifically, the corresponding compensation voltage V is added to each first pixel row that needs to be compensated, so as to ensure that the charging saturation of the pixel rows in each display panel are the same or basically the same.

Of course, in other embodiments, if the second pixel row in a group of pixels also encounters voltage climbing, the second pixel row is also compensated for the image data voltage, and a compensation voltage of the second pixel row is a difference between the image data voltages of the second row and the last row.

In one embodiment, the step of compensating image data voltage of a corresponding row according to the sorting labels specifically includes:

compensating an image data voltage of a first row in each group of image data with negative voltage polarity, and a compensation image data voltage of the first row being equal to a voltage difference between the first row of image data with negative voltage polarity and the last row of image data in each group of image data with negative voltage polarity.

After determining that number of pixel rows with negative voltage polarity for each group, such as two or three rows, the brightness of the display panel may be obtained. After acquiring the brightness of the display panel, by reading the voltage-brightness V-T curve of the display panel, the image data voltages of the pixel rows in each group are read through the voltage-brightness V-T curve. It can be understood that the climbing time of voltage switching is generally shorter, compared to the effect to the first row in a group of pixel rows, in the pixel group of image data with same image data voltage polarity, the image data voltage corresponding to the second row or each pixel rows after the second row has stabilized. Therefore, it is possible to calculate the difference between the image data voltages corresponding to the first pixel row and the last pixel row, so as to obtain the difference between the image data voltages corresponding to the first pixel row and the last pixel row, which is the compensation voltage V for the first pixel row. After acquiring the compensation voltage V of the first pixel row each group, the compensation voltage V of each pixel row can be stored in the sequential controller, and a look-up table of input and output of each first pixel row can be established in the sequential controller. When it is determined that the screen to be displayed is a heavy-load screen, the original data information is processed and output, specifically, the corresponding compensation voltage V is added to each first pixel row that needs to be compensated, so as to ensure that the charging saturation of the pixel rows in each display panel are the same or basically the same.

In one embodiment, the step of sorting rows of image data according to voltage polarities of the rows of image data and generating sorting labels of the rows of image data further includes:

sorting rows of image data with positive voltage polarity of each group according to an order of original image row numbers and generating the sorting labels. The original image row numbers are row numbers of the rows of image data in the image data.

In this embodiment, if a plurality of rows of image data in the image data have rows of image data with positive voltage polarity, the rows of image data with same voltage polarity are sorted according to the order of the original image row numbers, the original image row numbers are the row numbers of the rows of image data in the image data. For example, if the nth row of image data, the (n+2)th row of image data and the (n+4)th row of image data are a group of image data with positive voltage polarity, the three rows are sorted and labeled according to their orders in the original image, that is, the Nth row is labeled 1, the (n+2)th row is labeled 2, and the (n+4)th row is labeled 3.

Sorting rows of image data with negative voltage polarity of each group according to an order of the original image row numbers and generating the sorting labels. The original image row numbers are the row numbers of the rows of image data in the image data.

If a plurality of rows of image data in the image data have rows of image data with negative voltage polarity, the rows of image data with same voltage polarity are sorted according to the order of the original image row numbers, the original image row numbers are the row numbers of the rows of image data in the image data. For example, if the (n+1)th row of image data, the (n+3)th row of image data and the (n+5)th row of image data are a group of image data with negative voltage polarity, the three rows are sorted and labeled according to the orders of the three rows in the original image, that is, the (n+1)th row is labeled 1, the (n+3)th row is labeled 2, and the (n+5)th row is labeled 3.

It is also possible to sort the group of image data with positive voltage polarity and the group of image data with negative voltage polarity according to the order of the original image row numbers, for example, the nth row is positive, the (n+1)th row is negative, the (n+2)th is positive, the (n+3)th row is negative, the (n+4)th row is positive, the (n+5)th row is negative. The sorting labels corresponding to the 6 pixel rows on a normal display screen are 1 to 6, and the sorting labels corresponding to the 6 pixel rows on a heavy-load display screen are 1, 4, 2, 5, 3, and 6.

It can be understood that the sorting of units of image data can also be carried out according to the order of the original image row numbers. For example, when four pixel rows act as one unit of image data, the first unit of image data is G1 to G4, the second unit of image data is G5 to G8, and so on, so as to realize sorting of the units of image data.

In one embodiment, after the step of acquiring image data of a screen to be displayed, the method further includes:

scanning gate lines of the display panel row by row to display the screen to be displayed in responding to a determination that the image data of the screen to be displayed are image data of a normal screen.

In this embodiment, under a normal screen, the gate driver scans each pixel row row by row, the source driver receives the image data signal which does not need to be compensated by the sequential controller and the image data signal compensated by the sequential controller. When a corresponding pixel row is open, the source driver transmits the original data signal to the pixel row through all column data signal lines. The capacitor of each sub-pixel in the pixel row is charged to realize the writing and holding of the signal voltage of the sub-pixel, the liquid crystal molecules of the sub-pixel rotate under the signal voltage, so that the transmittance of the incident light passing through the liquid crystal molecules changes, i.e. the light valve function on the incident light is realized, the brightness of the projected light is changed, and finally the image display of the display panel is realized.

The disclosure also provides a driving circuit of a display panel.

Figure 2:
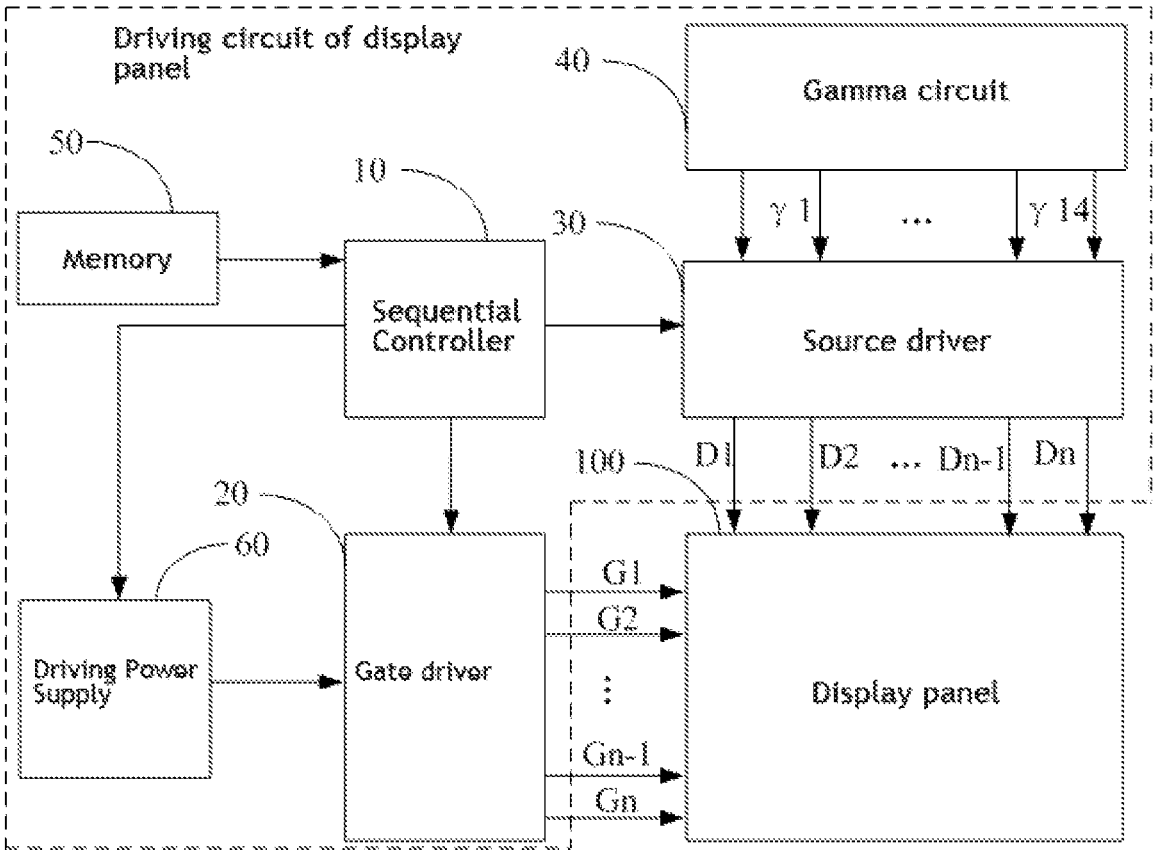
FIG. 2 is a schematic diagram of a circuit structure of an embodiment of a driving circuit of a display panel of the present disclosure.

Referring to FIG. 2, the driving circuit of the display panel includes:

a sequential controller 10 for acquiring image data of a screen to be displayed, acquiring a voltage polarity corresponding to each row of image data in the image data, in responding to a determination that the image data of the screen to be displayed are image data of a heavy-load screen, sorting rows of image data according to voltage polarities and generating sorting labels, and compensating image data voltage of a corresponding row;

a gate driver 20 for sequentially scanning gate lines of the display panel 100 according to the sorting labels;

a source driver 30 for outputting compensated image data of a row to a corresponding data lines of the display panel 100 to display the screen to be displayed.

In this embodiment, controlled terminals of the gate driver 20 and the source driver 30 are respectively connected to output terminals of the sequential controller 10. The sequential controller 10 receives the image data of the screen to be displayed transmitted by a front end, and the sequential controller 10 converts the image data and control signals received by the front end to data signals, control signals and clock signals suitable for the source driver 30 and the gate driver 20. The source driver 30 converts received digital signals into corresponding gray-scale voltage signals. As the gate drive 20 scans row by row, all column data signal lines transmit data signals to a pixel row, a capacitor of each sub-pixel in the pixel row is charged to realize the writing and holding of a signal voltage of the sub-pixel, and liquid crystal molecules of the sub-pixel rotate under the signal voltage to change the transmittance of the incident light passing through the liquid crystal molecules, i.e. to realize the light valve action on the incident light, to realize the change of the brightness of the projected light, and finally to realize the image display of the display panel 100. Among them, the signals output to the gate driver include a frame start signal (STV), a scan clock pulse signal (CPV), an output enable signal (OE), and the like.

Referring to FIG. 2, in some embodiments, the driving circuit of the display panel further includes a memory 40, which may be an EEPROM (Electrically Erasable Programmable read only memory) or a flash memory. The memory 40 and the sequential controller 10 may be provided on a sequential controller (TCON) PCB, The memory 40 can store control signals for driving the gate driver 20 and the source driver 30 to operate, and communicates with the sequential controller 10 through a serial communication bus. When a display device is powered on, the sequential controller 10 reads the control signals and other setting data from the memory 40 to perform initial setting to generate corresponding timing control signals to drive the operation of the display panel 100 in the display device, i.e. the data stored in the memory 40 are initialization data of the display panel 100.

Referring to FIG. 2, in one embodiment, the driving circuit of the display panel further includes a gamma circuit 50 set to produce a plurality of gamma voltages. The source driver 30 charges corresponding pixels according to the timing control signals and the gamma voltages output by the sequential controller 10, so that the source driver 30 outputs the data signals to the corresponding pixels and displays the image to be displayed. The gamma circuit 50 can optionally be implemented by a programmable gamma chip or by discrete components such as resistor strings and a memory 40, which can generate a set of gamma voltages (V1-V14) that can be used as pixel gray scale reference voltages.

The driving circuit of the display panel also includes a driving power supply 60, which integrates a plurality of DC-DC conversion circuits with different circuit functions and outputting different voltage values. An input voltage of the driving power supply 60 is generally 5V or 12V, and output voltages of the driving power supply 60 includes an operating voltage DVDD provided to the sequential controller 10, and a gate-on voltage Vgh and an off voltage Vg1 provided to the gate driver 20.

The disclosure discloses to acquire image data of a screen to be displayed through a sequential controller 10, and when the image data of the screen to be displayed is image data of a heavy-load screen, acquire a voltage polarity corresponding to each row of image data in the image data. Then rows of image data are sorted according to voltage polarities and sorting labels are generated. At the same time, image data voltage of a corresponding row is compensated according to the sorting labels, so that the gate driver 20 scans the gate lines of the display panel 100 in sequence according to the sorting labels, and the source driver 30 outputs compensated image data of the row to a corresponding data lines of the display panel 100 to display the screen to be displayed. According to the disclosure, pixel compensation is carried out on pixel rows with requirement to switch the voltage polarity, so that the charging efficiency of the pixel rows with requirement to switch the voltage polarity is consistent with the charging efficiency of pixel rows without requirement to switch the voltage polarity, and the charging effects of the pixel row are the same and the brightnesses of the pixel rows are consistent. The disclosure solves the problem that when the polarity of the image data voltage in a pixel row is reversed under a heavy-load screen, due to the larger voltage span, the charging saturation degrees of the pixel rows are different and the bright and dark rows appear. The disclosure improves the screen quality of the display device.

In one embodiment, the sequential controller 10 is further for setting the image data of the screen to be displayed as N units of image data. Each of the units of image data includes M groups of image data with positive voltage polarity and M groups of image data with negative voltage polarity. Each group of image data with positive voltage polarity and each group of image data with negative voltage polarity includes at least two rows of image data. M groups of rows of image data with positive voltage polarity and M groups of rows of image data with negative polarity are alternately sorted.

Rows of image data with positive voltage polarity of each group are sorted according to an order of original image row numbers and generating sorting labels. Rows of image data with negative voltage polarity of each group are sorted according to the order of the original image row numbers and generating sorting labels. The original image row numbers are row numbers of the rows of image data in the image data.

An image data voltage of a first row of image data in each group of image data with positive voltage polarity is compensated. And a compensation image data voltage is a voltage difference between the first row of image data with positive voltage polarity and the last row of image data in each group.

An image data voltage of a first image data of a row in each group of image data with negative voltage polarity is compensated. And a compensation image data voltage is a voltage difference between the first row of image data with positive voltage polarity and the last row of image data in each group.

After determining the number of pixel row whose voltage polarity is negative or positive for each group, such as two or three rows, it can acquire the brightness of the display panel 100. After acquiring the brightness of the display panel 100, by reading the voltage-brightness V-T curve of the display panel 100, the image data voltage of the pixel row in each group can be read through the voltage-brightness V-T curve, and the difference between the image data voltage corresponding to the first pixel row and the last pixel row can be calculated, so as to obtain the image data voltage difference corresponding to the first pixel row and the last pixel row, and the voltage difference is the compensation voltage V for the pixel row of the first row. When it is determined that the screen to be displayed is a heavy-load screen, the original data information is processed and output, specifically, the corresponding compensation voltage V is added to each first pixel row that needs to be compensated, so as to ensure that the charging saturation of the pixel rows in each display panel 100 are the same or basically the same.

The disclosure also provides a display device.

Referring to FIG. 2, the display device includes a display panel 100 and the driving circuit of a display panel described above. The driving circuit of the display panel is connected to the display panel 100. The detailed structure of the driving circuit of the display panel can refer to the above embodiments and will not be described here. As will be understood, since the driving circuit of the display panel described above is used in the display device of the present disclosure, the embodiments of the display device of the present disclosure includes all the technical solutions of all the embodiments of the driving circuit of the display panel described above, and the technical effects achieved are identical, and will not be repeated here.

In this embodiment, the display device may be a display device with the display panel 100, such as a television, a tablet computer, a mobile phone, etc. The display device also includes a timing control board and a source printed circuit board. The display panel 100 may be an OLED (Organic Light-Emitting Diode), or a TFT-LCD (Thin Film Transistor Liquid Crystal Display).

Figure 3:
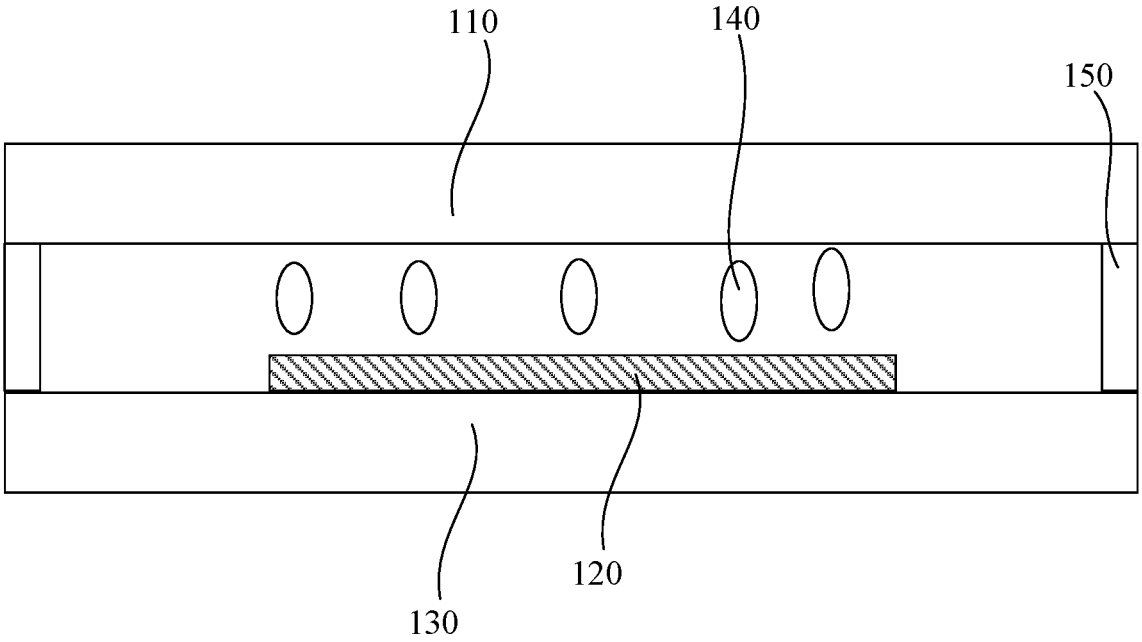
FIG. 3 is a schematic structural diagram of an embodiment of a display panel in a display device of the present disclosure.

Referring to FIG. 3, in one embodiment, the display panel 100 includes:

a color film substrate 110;

a pixel array 120;

an array substrate 130;

a liquid crystal layer 140 set between the array substrate 130 and the color film substrate 110. The liquid crystal layer 140 includes a plurality of liquid crystal molecules, and the pixel array 120 is for controlling operations of the plurality of liquid crystal molecules.

A plurality of scanning lines (G1, G2, G3 . . . Gn) arranged on the array substrate 130.

A plurality of data lines (D1, D2, D3 . . . Dn) disposed on the array substrate 130.

In this embodiment, the array substrate 130 and the color film substrate 110 are generally transparent material substrates such as glass substrates or plastic substrates. The color film substrate 110 and the array substrate 130 are arranged in pairs, and liquid crystal molecules are filled between the two. Corresponding circuits can be provided on the array substrate 130 and the color film substrate 110. The pixel array 120 is disposed on the array substrate 130.

In the above embodiments, the pixel array 120 includes a plurality of sub-pixels. Each of the sub-pixels includes an active switch (thin film transistor) and a pixel electrode. A gate of the active switch is electrically connected to a scanning line corresponding to the sub-pixel. A source of the active switch is electrically connected to a data line corresponding to the pixel unit 130, and a drain of the active switch is electrically connected to the pixel electrode of the sub-pixel. The pixel array 120 also includes an array of pixel electrodes connected to an array of active switches. Each scanning line is connected with gates of active switches of a plurality of sub-pixels, thus a respective pixel row is formed. Each data line (or each pixel electrode) is connected with sources of active switches of a plurality of sub-pixel to form each pixel column, and a common electrode is also formed on the display panel, and the common electrode is connected with a drain of a main control switch.

The display panel 100 is composed of a plurality of pixels, each of which is composed of three sub-pixels of red, green and blue. Each sub-pixel circuit structure is generally provided with a thin film transistor and a capacitor. A gate of the thin film transistor is connected to the gate driver 20 through a scanning line. A source of the thin film transistor is connected to the source driver 30 through a data line. And a drain of the thin film transistor is connected to one terminal of the capacitor. Among them, a plurality of thin film transistors form a thin film transistor array (not shown in the figure). The thin film transistors located in a same column are connected to the source driver 30 through a data line, and the thin film transistors located in a same row are connected to the gate driver 20 through a scan line, thus forming a thin film transistor array. Those thin film transistors can be a-Si (non-silicon) thin film transistors or Poly-Si (polysilicon)

thin film transistors, the Poly-Si thin film transistors can be formed under technologies such as LTPS (Low Temperature Poly-Silicon) and the like.

It will be understood that in the above embodiment, the display panel 100 further includes a frame glue 150 disposed in a non-display region between the array substrate 130 and the color film substrate 110 and disposed around the liquid crystal layer 140. The frame glue 150 may be applied to the array substrate 130 or the color film substrate 110 using sealant to connect the array substrate 130 and the color film substrate 110, thereby realizing the assembly of the display panel 100. A black matrix and a color filter (CF) are formed on the color film substrate 110. The common electrode may be formed on the color film substrate 100 in a vertical electric field driving mode of twisted nematic (TN) mode or vertical alignment (VA) mode, or may be formed on the array substrate 100 together with the pixel electrodes in a horizontal electric field driving mode of in-plane switching (IPS) mode or edge field switching (FFS) mode.

The foregoings are only optional embodiments of the disclosure and are not thus limiting the scope of the patent of the disclosure. Any equivalent structural transformation made under the inventive concept of the disclosure using the contents of the specification and the accompanying drawings, or any direct/indirect application in other related technical fields, is included in the scope of the patent protection of the disclosure.

The invention claimed is:

1. A driving method of a display panel, comprising the following steps:

acquiring image data of a screen to be displayed;

acquiring a voltage polarity corresponding to each row of image data in the image data, in responding to a determination that the image data of the screen to be displayed are image data of a heavy-load screen;

sorting rows of image data according to voltage polarities and generating sorting labels;

compensating image data voltage of a corresponding row according to the sorting labels;

scanning gate lines of the display panel in sequence according to the sorting labels; and, outputting compensated image data of the corresponding row to a corresponding data line of the display panel to display the screen to be displayed;

wherein, the step of the sorting rows of image data according to the voltage polarities and generating the sorting labels comprises:

setting the image data of the screen to be displayed as N units of image data, each of the units of image data comprising M groups of image data with positive voltage polarity and M groups of image data with negative voltage polarity, each group of image data with the positive voltage polarity and each group of image data with the negative voltage polarity comprising at least two rows of image data;

alternately sorting the M groups of rows of image data with positive voltage polarity and the M groups of rows of image data with negative voltage polarity.

2. The driving method according to claim 1, wherein the step of compensating the image data voltage of the corresponding row according to the sorting labels comprises:

compensating an image data voltage of a first row in each group of image data with positive voltage polarity, a compensation image data voltage of the first row being equal to a voltage difference between the first row of image data with positive voltage polarity and a last row of image data in each group of image data with positive voltage polarity.

3. The driving method according to claim 2, wherein after the step of acquiring the image data of the screen to be displayed, the method further comprises:

scanning the gate lines of the display panel row by row to display the screen to be displayed in responding to a determination that the image data of the screen to be displayed are image data of a normal screen.

4. The driving method according to claim 1, wherein the step of compensating the image data voltage of the corresponding row according to the sorting labels comprises:

compensating an image data voltage of a first row in each group of image data with negative voltage polarity, and a compensation image data voltage of the first row being equal to a voltage difference between the first row of image data with negative voltage polarity and a last row of image data in each group of image data with negative voltage polarity.

5. The driving method according to claim 4, wherein after the step of acquiring the image data of the screen to be displayed, the method further comprises:

scanning the gate lines of the display panel row by row to display the screen to be displayed in responding to a determination that the image data of the screen to be displayed are image data of a normal screen.

6. The driving method according to claim 1, wherein the step of sorting the rows of image data according to the voltage polarities and generating the sorting labels further comprises:

sorting rows of image data with positive voltage polarity of each group according to an order of original image row numbers and generating the sorting labels, the original image row numbers being row numbers of the rows of image data in the image data.

7. The driving method according to claim 6, wherein after the step of acquiring the image data of the screen to be displayed, the method further comprises:

scanning the gate lines of the display panel row by row to display the screen to be displayed in responding to a determination that the image data of the screen to be displayed are image data of a normal screen.

8. The driving method according to claim 1, wherein the step of sorting the rows of image data according to the voltage polarities and generating the sorting labels further comprises:

sorting rows of image data with negative voltage polarity of each group according to an order of the original image row numbers and generating the sorting labels, the original image row numbers being the row numbers of the rows of image data in the image data.

9. The driving method according to claim 8, wherein after the step of acquiring the image data of the screen to be displayed, the method further comprises:

scanning the gate lines of the display panel row by row to display the screen to be displayed in responding to a determination that the image data of the screen to be displayed are image data of a normal screen.

10. The driving method according to claim 1, wherein after the step of acquiring the image data of the screen to be displayed, the driving method further comprises:

scanning the gate lines of the display panel row by row to display the screen to be displayed in responding to a determination that the image data of the screen to be displayed are image data of a normal screen.

11. A driving circuit of a display panel comprising:

a sequential controller for acquiring image data of a screen to be displayed, acquiring a voltage polarity corresponding to each row of image data in the image data, in responding to a determination that the image data of the screen to be displayed are image data of a heavy-load screen, sorting rows of image data according to voltage polarities and generating sorting labels, and compensating image data voltage of a corresponding row according to the sorting labels;

a gate driver for sequentially scanning gate lines of the display panel according to the sorting labels;

a source driver for outputting compensated image data of the corresponding row to a corresponding data line of the display panel to display the screen to be displayed;

wherein, the sequential controller is further for:

setting the image data of the screen to be displayed as N units of image data, each of the units of image data comprising M groups of image data with positive voltage polarity and M groups of image data with negative voltage polarity, each group of image data with the positive voltage polarity and each group of image data with the negative voltage polarity comprising at least two rows of image data, and alternately sorting the M groups of rows of image data with positive voltage polarity and the M groups of rows of image data with negative voltage polarity;

sorting rows of image data with positive voltage polarity of each group according to an order of original image row numbers and generating sorting labels, the original image row numbers being row numbers of the rows of image data in the image data, sorting rows of image data with negative voltage polarity of each group according to the order of the original image row numbers and generating sorting labels, the original image row numbers being the row numbers of the rows of image data in the image data;

compensating an image data voltage of a first row in each group of image data with positive voltage polarity, a compensation image data voltage of the first row being equal to a voltage difference between the first row of image data with positive voltage polarity and a last row of image data in each group of image data with positive voltage polarity; and compensating an image data voltage of a first row in each group of image data with negative voltage polarity, and a compensation image data voltage of the first row being equal to a voltage difference between the first row of image data with negative voltage polarity and a last row of image data in each group of image data with negative voltage polarity.

12. A display device comprising a display panel and the driving circuit according to claim 11, the driving circuit being connected with the display panel.

13. The display device according to claim 12, wherein the sequential controller is further for:

setting the image data of the screen to be displayed as N units of image data, each of the units of image data comprising M groups of image data with positive voltage polarity and M groups of image data with negative voltage polarity, each group of image data with the positive voltage polarity and each group of image data with the negative voltage polarity comprising at least two rows of image data, and alternately sorting the M groups of rows of image data with positive voltage polarity and the M groups of rows of image data with negative voltage polarity;

sorting rows of image data with positive voltage polarity of each group according to an order of original image row numbers and generating sorting labels, the original image row numbers being row numbers of the rows of image data in the image data, sorting rows of image data with negative voltage polarity of each group according to the order of the original image row numbers and generating sorting labels, the original image row numbers being the row numbers of the rows of image data in the image data;

compensating an image data voltage of a first row in each group of image data with positive voltage polarity, a compensation image data voltage of the first row being equal to a voltage difference between the first row of image data with positive voltage polarity and a last row of image data in each group of image data with positive voltage polarity; and compensating an image data voltage of a first row in each group of image data with negative voltage polarity, and a compensation image data voltage of the first row being equal to a voltage difference between the first row of image data with negative voltage polarity and a last row of image data in each group of image data with negative voltage polarity.

* * * * *